US010646735B2

(12) United States Patent
Magnone et al.

(10) Patent No.: US 10,646,735 B2
(45) Date of Patent: May 12, 2020

(54) SYSTEM AND METHODS FOR WET SYSTEM FIRE PROTECTION

(71) Applicant: TYCO FIRE PRODUCTS LP, Lansdale, PA (US)

(72) Inventors: Zachary L. Magnone, Warwick, RI (US); Jeremiah P. Crocker, Park City, UT (US); John Desrosier, East Greenwich, RI (US); Sean E. Cutting, West Warwick, RI (US); Manuel R. Silva, Jr., Cranston, RI (US)

(73) Assignee: Tyco Fire Products LP, Lansdale, PA (US)

( * ) Notice: Subject to any disclaimer, the term of this patent is extended or adjusted under 35 U.S.C. 154(b) by 263 days.

(21) Appl. No.: 15/329,533

(22) PCT Filed: Jul. 27, 2015

(86) PCT No.: PCT/US2015/042300

§ 371 (c)(1),
(2) Date: Jan. 26, 2017

(87) PCT Pub. No.: WO2016/018827

PCT Pub. Date: Feb. 4, 2016

(65) Prior Publication Data

US 2017/0216641 A1 Aug. 3, 2017

Related U.S. Application Data

(60) Provisional application No. 62/029,981, filed on Jul. 28, 2014.

(51) Int. Cl.
*A62C 35/60* (2006.01)
*A62C 3/00* (2006.01)

(52) U.S. Cl.
CPC ..... *A62C 35/60* (2013.01); *A62C 3/002* (2013.01); *Y10T 137/7759* (2015.04); *Y10T 137/7761* (2015.04); *Y10T 137/86397* (2015.04)

(58) Field of Classification Search
CPC ... A62C 35/60; A62C 3/002; Y10T 137/7759; Y10T 137/7761; Y10T 137/86389; Y10T 137/86397

(Continued)

(56) References Cited

U.S. PATENT DOCUMENTS 1,738,656 A * 12/1929 Lowe ..... A62C 35/605 169/23
2,537,009 A * 1/1951 Allen ..... A62C 99/009 169/9

(Continued)

FOREIGN PATENT DOCUMENTS

GB 2 243 080 10/1991

OTHER PUBLICATIONS

International Search Report and Written Opinion on PCT/US2015/042300, dated Nov. 4, 2015, 9 pages.

*Primary Examiner* — Alex M Valvis
*Assistant Examiner* — Joseph A Greenlund
(74) *Attorney, Agent, or Firm* — Foley & Lardner LLP

(57) ABSTRACT

Wet fire protection systems and methods for the protection of a stored commodity are provided. The system includes a supply portion coupled to a water supply and a demand portion including a plurality of sprinklers disposed above the commodity with each sprinkler having an operating pressure range. The plurality of sprinklers are interconnected by a network of pipes filled with water to provide each sprinkler with an initial pressure of water. A pressure control assembly is disposed between the supply portion and the demand (Continued)

portion to withhold fluid pressure from the supply portion from pressurizing the demand portion for a predetermined withholding period following actuation of at least one sprinkler in response to a fire.

26 Claims, 5 Drawing Sheets

(58) Field of Classification Search
USPC ..... 169/46; 137/487.5, 624.11–624.22
See application file for complete search history.

(56) References Cited

U.S. PATENT DOCUMENTS 4,359,097 A * 11/1982 Claussen ..... A62C 35/60 137/487
4,735,231 A * 4/1988 Jacquet ..... F17D 5/02 137/459
4,830,116 A * 5/1989 Walden ..... A62C 2/04 169/17
4,905,765 A * 3/1990 Hein ..... A62C 37/40 169/19
5,511,621 A * 4/1996 Yao ..... A62C 99/0009 169/17
5,992,532 A * 11/1999 Ramsey ..... A62C 37/36 169/17
6,390,203 B1 * 5/2002 Borisov ..... A62C 3/07 169/60
6,535,827 B1 * 3/2003 Lestina ..... F17D 5/02 137/486
6,837,271 B1 * 1/2005 Saint ..... G01M 3/2807 137/460
6,840,457 B2 * 1/2005 Park ..... A62C 35/68 169/16
7,363,987 B2 * 4/2008 Grant ..... A62C 35/58 169/16
7,857,069 B2 12/2010 Yu
8,733,461 B2 * 5/2014 Pigeon ..... A62C 35/58 169/16
9,381,386 B2 * 7/2016 Pigeon ..... A62C 3/002
10,317,264 B1 * 6/2019 Nesselle ..... G01M 1/00
2006/0060361 A1 * 3/2006 Pounder ..... A62C 37/14 169/37
2006/0289174 A1 * 12/2006 Yu ..... A62C 35/58 169/16
2007/0034387 A1 * 2/2007 Andersen ..... A62C 99/0027 169/16
2008/0128143 A1 * 6/2008 Yu ..... A62C 35/605 169/16
2008/0257564 A1 * 10/2008 Cordell ..... A62C 35/62 169/17
2008/0319716 A1 * 12/2008 Golinveaux ..... A62C 3/002 703/1
2011/0036598 A1 * 2/2011 Pahila ..... A62C 3/002 169/37
2012/0024393 A1 * 2/2012 Menet ..... F17D 5/06 137/14
2012/0230846 A1 * 9/2012 Stephens ..... A62C 3/00 417/279
2013/0092242 A1 * 4/2013 Guy ..... E03B 7/071 137/2
2014/0102729 A1 * 4/2014 Ringer ..... A62C 35/68 169/17
2014/0374125 A1 * 12/2014 Johnson ..... A62C 35/68 169/16
2015/0027739 A1 * 1/2015 Multer ..... A62C 3/002 169/43
2017/0007864 A1 * 1/2017 Magnone ..... A62C 37/40
2017/0113078 A1 * 4/2017 Magnone ..... A62C 35/58
2017/0120090 A1 * 5/2017 Magnone ..... A62C 3/002
2017/0216641 A1 * 8/2017 Magnone ..... A62C 3/002

* cited by examiner

SYSTEM AND METHODS FOR WET SYSTEM FIRE PROTECTION

PRIORITY DATA & INCORPORATION BY REFERENCE

This application is a 35 U.S.C. § 371 application of International Application No. PCT/US2015/042300 filed Jul. 27, 2015, which claims the benefit of priority to U.S. Provisional Patent Application No. 62/029,981, filed Jul. 28, 2014, each of which is incorporated by reference in its entirety.

TECHNICAL HELD

The present invention relates generally to wet system fire protection designs, installations and methodologies.

BACKGROUND OF THE INVENTION

A "Wet Pipe Sprinkler System" is defined as a sprinkler system employing automatic sprinklers attached to a piping system containing water and connected to a water supply. Upon actuation of the automatic sprinkler in response to a fire, water is immediately discharged at a minimum designed, working or operating pressure to address the fire. As used herein, "operating pressure" is defined as the pressure required at the sprinkler head to achieve the designed performance objective of the sprinkler, e.g., standard spray, control mode, suppression, extended coverage, etc., under liquid flow conditions. The designed operating pressure preferably ranges from a minimum operating pressure, as preferably determined by industry accepted installation standards, such as for example the National Fire Protection Association (NFPA) standard, entitled "NFPA 13: Standards for the Installation of Sprinkler Systems" (2013 ed.) ("NFPA 13"), or the FM Global installation standard, to a maximum operating pressure as determined by the sprinkler designer or manufacturer or applicable standards. For example, NFPA 13 specifies a minimum operating pressure of 30 PSI for Control Mode Specific Application (CMSA) protection of Class I-IV rack storage over twenty-five feet in height with CMSA pendent sprinklers.

U.S. Pat. No. 7,857,069 (the "'069 patent") is directed to methods of system valve actuation for a "deluge-like" wet pipe sprinkler system as shown and described in U.S. Patent Publication No. 2006/0289174 (the "'174 Publication"), which is directed to "deluge-like" sprinkler fire scheme using high thermal sensitivity and high temperature rating sensing elements. According to the '174 Publication, the "deluge-like" systems improve the fire protection performance of dry or controlled wet systems by purportedly preventing the problem of "sprinkler skipping." These "deluge-like" systems operate by ensuring a designated number of automatic sprinkler actuations over a fire before operating a system fluid control valve for delivery of water from the actuated sprinklers at operating pressure. Essential to the overall system operation in reducing fire damage is the actuation of the system fluid control valve after or shortly before all sprinklers in a designated area above a small size fire have actuated in response to the fire so that the sprinklers in the designated area discharge at their designated operating pressure. According to the specification of the '174 Publication, valve operation and water application to the smaller size fires is made possible by the use of high thermally sensitive sprinklers (low RTI values 40-100 (ft-sec)$^{1/2}$ [22-55 (meter-seconds)$^{1/2}$]) with high temperature ratings (190°–650° F.).

The time at which a sprinkler actuates in response to a fire is determined, at least in part, by the sprinkler's temperature characteristics and more specifically its temperature rating and its thermal sensitivity. The nominal temperature rating of a thermally responsive trigger and its sprinkler defines the temperature range at which the sprinkler and its trigger will actuate. The thermal sensitivity of the sprinkler and its trigger is measured or quantified by the response time index ("RTI") meter$^{1/2}$ second$^{1/2}$ ("m$^{1/2}$ sec$^{1/2}$") as determined in a standardized test arrangement generally described in NFPA 13, in which the sprinkler is disposed within a test oven and exposed to a heated laminar airflow within the test oven. The RTI is calculated using the following: (i) the operating time of the sprinkler; (ii) the operating temperature (temperature rating) of the sprinkler; (iii) the air temperature of the test oven; (iv) the air velocity of the test oven; and (v) the conductivity between the sprinkler and its mount in the oven. According to NFPA 13, sprinklers are defined as "fast response" where its thermally responsive trigger has an RTI of 50 m$^{1/2}$ sec$^{1/2}$ or less. Sprinklers with an thermally responsive trigger having an RTI of 80 m$^{1/2}$ sec$^{1/2}$ or more are defined as "standard response." Other standards recognize sprinklers having a thermally responsive trigger between 50 m$^{1/2}$ sec$^{1/2}$ and 80 m$^{1/2}$ sec$^{1/2}$ as "special response." For commonality as used herein, a "fast response sprinkler" will refer to sprinkler having a thermally responsive trigger with an RTI of less than 80 m$^{112}$ sec$^{1/2}$; and "a standard response" is greater than 80 m$^{1/2}$ sec$^{1/2}$.

Again, in these known "deluge-like" systems no water is discharged at pressure from any actuated sprinkler until essentially all the designated sprinklers have been actuated. Fluid pressure is thus delayed in the system and methods of the '069 patent and the '174 Publication and system operation is reactive in the sense that the system operation is dependent upon a group of designated sprinkler actuations before operating the system fluid control valve. The '069 patent describes two methods of actuating the system fluid control valve of a "deluge-like" system to deliver the fluid pressure. Generally, the system valve is controlled open in response to a flow condition in the system piping following actuation of a designated number of sprinklers. More specifically, the operation of the system fluid control valve is based upon the designated number of sprinkler actuations that generate a threshold pressure drop and/or a threshold flow through the system piping. The preferred methods of operation require special piping arrangements, e.g. a bypass, and/or special piping sensor arrangements to detect the operative flow conditions. Because water pressure is delayed, the '174 indicates that the required number of system valves should be kept small or the thermal sensitivity of the system increased to ensure time operation of the system valve. Accordingly, there are limitations and or complexities in the implementation of these known "deluge-like" wet systems. Moreover, although the systems of the '069 patent and the '174 Publication address the issue of sprinkler skipping, the documents fail to provide methods and associated systems that allow for either a systematic approach for reducing total water flow or demand or for fire protection at ceiling heights not previously realized.

Therefore, there remains a need for wet systems that deliver fluid pressure to a group of thermally actuated sprinklers in which system delivery of fluid pressure is independent of the number of actual sprinkler actuations. Moreover, it is desirable to provide for systems and method of storage fire protection which have a total fluid flow demand that is less than known systems protecting similar storage configurations. Additionally, it is desirable to provide for storage fire protection at heights not yet available in known systems.

DISCLOSURE OF THE INVENTION

Provided are preferred systems and methods for fire wet system fire protection in which fluid pressure is delivered to one or more thermally actuated sprinklers in a predictive predetermined timed manner following thermal actuation of at least one sprinkler. In preferred embodiments of the fire protection system, a pressure control assembly maintains a standby state to prevent or withhold fluid pressure from the sprinklers of the system. Upon thermal actuation of at least one sprinkler and the expiration of a predetermined range of time, i.e., a withholding period, the pressure control assembly operates to deliver fluid pressure to the thermally actuated sprinklers at its operating pressure to effectively address a fire. Accordingly, pressurized application of firefighting fluid from the preferred systems described herein, unlike conventional wet systems, is preferably transient. Moreover, because the systems described herein operate upon expiration of a predetermined predictable range or period of time following one sprinkler actuation, system operation is not dependent upon the actuation of a particular or designated number or area of sprinklers above a fire. Accordingly, the preferred fire protection systems described herein are not reactive to the particularized flow conditions within the piping of the system to operate and deliver fluid pressure to the thermally actuated sprinklers. Thus, the preferred system arrangements can be more simply implemented as compared to known reactive systems. Additionally, because the preferred operation of the fluid control assembly does not depend upon detection of a designated number of sprinkler actuations within a particular amount of time, the preferred systems can be implemented using standard response sprinklers or fast response sprinklers so long as the sprinklers are suitably selected and installed for the occupancy and hazard to be protected.

Preferred embodiments of wet sprinkler systems and methods of fire protection provide for transient pressure control of the discharged firefighting fluid. Upon expiration of the predetermined withholding period, fluid pressure is provided or restored to the actuated sprinklers to provide the actuated sprinklers with their designed operating pressure. The preferred transient systems and methods employing the preferred predetermined withholding period require less water to address a fire when compared to known wet systems that do not employ a withholding period because it is believed that there are fewer sprinkler activations when a withholding period is used. Thus, the preferred transient wet systems require less total fluid flow in operation and therefore can be hydraulically designed with smaller design areas or fewer design sprinklers as compared to known systems.

Preferred methods and systems of wet ceiling-only fire protection for the protection of storage occupancies and more preferably rack storage are also provided. As described herein, the preferred methods and systems identify and implement a preferred withholding period in combination with other sprinkler, occupancy and or storage characteristics, parameters, or arrangements occupancy to provide for storage fire protection at heights not yet available in known systems.

A preferred wet ceiling-only fire protection system for protection of a stored commodity includes a supply portion coupled to a water supply and a demand portion having a plurality of sprinklers disposed above the commodity with each of the plurality of sprinklers preferably having a minimum designed operating pressure range. The plurality of sprinklers are interconnected by a network of pipes filled with water to provide each sprinkler with an initial pressure of water. The supply portion is coupled to the demand portion and configured for pressurizing the demand portion following actuation of at least one sprinkler in response to a fire and expiration of a predetermined withholding period. An assembly is coupled to the demand portion for determining the expiration of the predetermined withholding period.

The assembly is preferably a pressure control assembly disposed between the supply portion and the demand portion to withhold fluid pressure from the supply portion from pressurizing the demand portion for a predetermined withholding period following actuation of at least one sprinkler in response to a fire beneath the sprinklers. The pressure control assembly preferably includes a valve having a standby state which prevents fluid communication between the supply portion and the demand portion and an operated state which permits fluid communication between the supply portion and the demand portion. The pressure control assembly further preferably includes a timing device which initiates countdown of the predetermined withholding period following the actuation of the at least one sprinkler. The timing device is preferably coupled to the valve to transition the valve from the standby state to the operated state.

A preferred method for providing a wet ceiling-only fire protection system having a supply portion and a demand portion including a plurality of sprinklers. The preferred method includes determining a withholding period for withholding fluid pressure from the demand portion of the system following actuation of at least one sprinkler in the demand portion in response to a fire; and specifying a design area of the demand portion, the design area being defined by a maximum number of sprinklers activated to one of control or suppress a fire in a fire test that incorporates the withholding period.

Embodiments of the methods and systems include preferred design parameters or criteria. For example, the preferred predetermined withholding period is greater than zero and preferably less than fifteen seconds, more preferably greater than zero and less than ten seconds, and even more preferably the predetermined withholding period ranges between five seconds and less than ten seconds. In preferred embodiments of the systems and methods, the sprinklers used therein include standard response sprinklers with a K-Factor greater than 11 and the withholding period ranges from 5-15 seconds. In preferred embodiments of the systems and methods of fire protection for storage, the sprinklers are preferably disposed to define a deflector-to-ceiling distance of twelve inches (12 in.).

In a preferred embodiment of the system, the plurality of sprinklers of the demand portion are disposed above rack storage of Group A plastic and/or Class I-IV commodity having a nominal storage height ranging from 20 ft.-30 ft. under a nominal ceiling height of 35 ft. to define a nominal clearance of 5-15 feet. The sprinklers of the system have a nominal 16.8 K-factor and are disposed at a sprinkler-to-sprinkler spacing of 10 ft.×10 ft. The preferred demand portion of the system includes one of eight (8) or twelve (12) design sprinklers with a minimum operating pressure of 35 PSI.

In another preferred embodiment of a wet ceiling-only fire protection system, wherein the plurality of sprinklers are disposed above rack storage of Class I-IV commodity having a nominal storage height ranging from 40 ft.-50 ft. under a nominal ceiling height ranging from 50 ft.-55 ft. to define a nominal clearance of 5-15 feet. The plurality of sprinklers have a nominal 33.6 K-factor and are disposed at a sprinkler-to-sprinkler spacing of 10 ft.×10 ft. The demand portion preferably includes one of one of six (6), seven (7), eight (8) or nine (9) design sprinklers with a minimum operating pressure of 50 PSI. The withholding period of the system preferably ranges from 5-10 seconds. Sprinklers of the preferred embodiments have a temperature rating of 286° F.

In alternate embodiments of the systems and methods, the sprinklers include fast response sprinklers with K-Factor greater than 11 with the withholding period ranges from 5-15 seconds. The sprinklers are preferably disposed at a deflector-to-ceiling distance of six inches (6 in.). The sprinklers of preferred embodiments for wet ceiling-only fire protection for storage are disposed above rack storage of Group A plastic and/or Class I-IV commodity having a nominal storage height ranging from 30 ft.-40 ft. under a nominal ceiling height of 45 ft. to define a nominal clearance of 10-15 feet, the sprinklers having a nominal 25.2 K-factor disposed at a sprinkler-to-sprinkler spacing of 10 ft.×10 ft. The demand portion of the preferred system include one of eight (8) or twelve (12) design sprinklers with a minimum operating pressure of 45 PSI with preferred withholding period of the system ranging from 7-9 seconds. The sprinklers of the preferred system have a temperature rating of 212° F.

Another preferred embodiment of a wet fire protection method includes obtaining a sprinkler satisfying a fire test when subjected to a predetermined withholding period following thermal actuation of at least one of the plurality of sprinklers in response to a fire. The method further preferably includes providing the sprinklers for installation in a wet fire protection system employing the predetermined withholding period.

Another preferred method is provided for approving a wet fire suppression protection system having a demand portion and a supply portion. The preferred method includes determining that the system has a pressure control device configured to operate at the expiration of a predetermined withholding period for delivery of water to each of a plurality of suppression sprinklers in the system at a pressure equal to or greater than the minimum design operating pressure of the sprinkler. The preferred method also includes verifying the most hydraulically demanding sprinkler is pressurized to at least the minimum design operating pressure following discharge of water from the demand portion and the expiration of the withholding period.

Another preferred method is provided for wet fire system installation for protection of a stored commodity. The method preferably includes identifying a sprinkler satisfying a fire test when subjected to a predetermined withholding period; and specifying the predetermined withholding period for withholding a designed operating pressure of water from a plurality of the identified sprinklers installed in the wet system following thermal actuation of at least one of the plurality of sprinklers in response to a fire.

Although the Disclosure of the Invention and the preferred systems and methods can provide for a reduced hydraulic demand in a wet pipe sprinkler system as compared to known hydraulic designs under known standards, it is to be understood that the preferred systems cover all wet system designs. Moreover, the preferred systems and methods describe a preferred predetermined withholding period of greater than zero and up to fifteen seconds (>0-15 secs.). However, it should be understood that other predetermined withholding periods are possible for use in the system and methods described, for example, a withholding period greater than fifteen seconds; that is for example, any appropriate withholding period can be utilized so long as the hydraulic design of the system is substantially equal to or less than that for known wet commercial fire protection system and/or the storage commodity is at a greater height than know commercial systems. The Disclosure of the Invention is provided as a general introduction to some embodiments of the invention, and is not intended to be limiting to any particular configuration or system. It is to be understood that various features and configurations of features described in the Disclosure of the Invention can be combined in any suitable way to form any number of embodiments of the invention. Some additional preferred embodiments including variations and alternative configurations are provided herein.

BRIEF DESCRIPTION OF DRAWINGS

The accompanying drawings, which are incorporated herein and constitute part of this specification, illustrate exemplary embodiments of the invention and, together with the general description given above and the detailed description given below, serve to explain the features of the preferred embodiments of the invention. It should be understood that the preferred embodiments are some examples of the invention as provided by the appended claims.

DETAILED DESCRIPTION OF THE PREFERRED EMBODIMENTS

Figure 1:
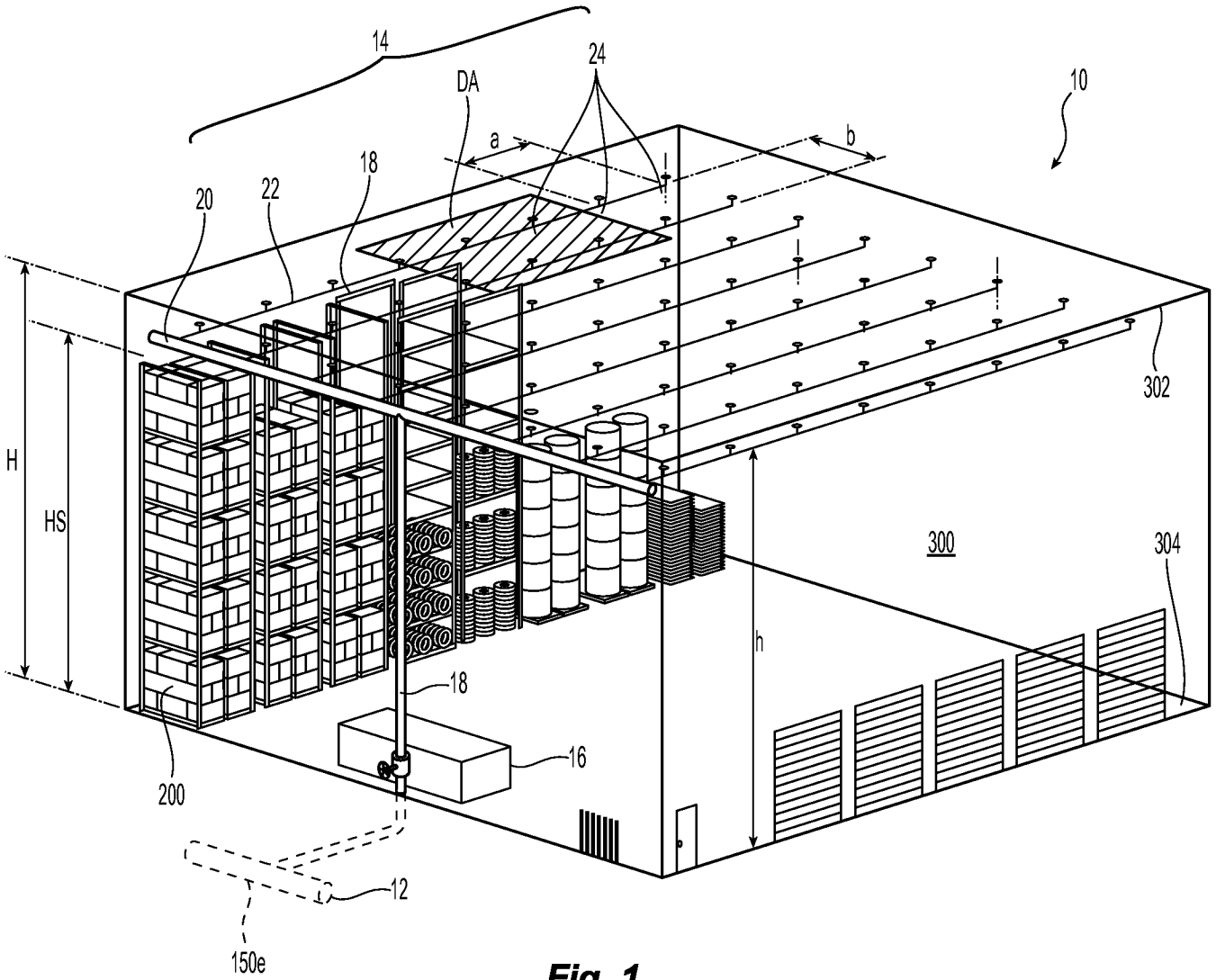
FIG. 1 is an illustrative preferred embodiment of a wet fire protection system for a storage occupancy.

Shown in FIG. 1 is an illustrative embodiment of a preferred transient pressure wet fire protection system 10 having a network of fire protection sprinkler heads 24 interconnected by fluid supply branch lines to address a fire in a storage occupancy 300 with any one of either fire control or fire suppression performance. The system 10 maintains water or other firefighting fluid in its piping up to the sprinkler heads 24 at an initial pressure. The initial pressure can be any one of less than, greater than, or equal to the minimum working or operating pressure of the sprinkler head 24. Upon thermal actuation of one or more sprinklers in response to a fire, water is immediately discharged from the actuated sprinkler head(s) 24. However unlike prior wet systems, the preferred transient wet system 10 is configured to withhold fluid pressure from the sprinklers for a predetermined period of time, a "withholding period," following thermal actuation of one or more sprinklers. Once the predetermined withholding period has expired, water pressure is provided to each sprinkler in an amount equal to or greater than a minimum operating pressure for the system 10 to provide its designed performance. More particularly, the minimum operating pressure of the preferred system 10 is the minimum pressure for effectively addressing a fire with any one of fire control or suppression following the withholding period.

The transient system 10 includes a supply portion 12 and a demand portion 14 separated from one another by a pressure control device or assembly 16 to control and more particularly withhold fluid pressure from the demand portion 14 for the predetermined withholding period following initial thermal actuation of one or more sprinklers. The supply portion 12 is preferably connected to a supply of firefighting liquid such as, for example, a water main or water tank. The supply portion 12 can further include additional devices (not shown) such as, for example, fire pumps, or backflow preventers, to deliver the water to the demand portion 14 at a desired flow rate and/or pressure. The demand portion 14 includes the network of sprinkler heads 24 disposed above the commodity(ies) 200 and interconnected by a network of pipes filled with water or other firefighting liquid. Preferably, the demand portion 14 includes a riser pipe 18 which extends from and connects the pressure control device 16 to one or more main pipes 20 from which one or more branch lines or pipes 22 extend. Coupled to the branch lines 22 are one or more automatic fire protection sprinkler heads or sprinklers 24, each preferably configured to provide a particular sprinkler performance for addressing a fire, for example, with any one of either fire control or fire suppression performance. The sprinklers 24, branch lines 22 and main pipe(s) 20 can be arranged relative to the riser 18 and supply portion 12 so as to define either one of a gridded network or a tree network, as is described in NFPA 13, Annex A, FIGS. A.3.4.6 & A.3.4.7. The network of pipes 20, 22 can further include pipe fittings such as connectors, elbows and risers, etc. to interconnect the demand portion 14.

In an unactuated state of the system 10, the demand portion 14 of the transient system 10 is filled with water such that each sprinkler 24 is provided at its inlet with an initial water pressure preferably within the operating pressure range of the sprinklers 24. Alternatively, the initial pressure can be less or greater than the minimum operating pressure. In response to a fire below the network of sprinklers, the transient system 10 operates with thermal activation or actuation of one or more sprinklers 24. Water is discharged from the activated sprinklers 24 and the initial pressure of the demand portion 14 is permitted to drop or decrease for a predetermined period of time, i.e., the withholding period, as pressurized fluid is withheld from the demand portion 14. The preferably predetermined withholding period preferably ranges from greater than zero seconds to fifteen seconds (>0 sec.-15 sec.); more preferably ranges from greater than zero seconds to ten seconds (>0 sec.-10 sec.); even more preferably ranges from about five seconds to ten seconds (5 sec.-10 sec.); and is preferably about six seconds.

During the withholding period it is anticipated that the fire will grow and heat the gas near the ceiling 302 of the storage occupancy 300 and direct the air flow proximate the ceiling. Over the duration of the withholding period, a number and/or sequence of sprinkler activations is anticipated. At the expiration of the withholding period, the demand portion 14 is pressurized with water such that each sprinkler 24 is provided with a terminal or end pressure equal to or greater than the minimum operating pressure of the sprinkler 24. Accordingly, the preferred number of thermally actuated sprinklers 24 discharge water under an operating pressure to effectively address the fire and protect the storage occupancy 300.

To control the pressure in the demand portion 14 before and during the withholding period, the transient system 10 preferably includes the pressure control device or assembly 16. The pressure control device 16 preferably has a standby state and an operated state. In the standby state, the preferred pressure control device 16 prevents fluid from the supply portion 12 from pressurizing the demand portion 14 during the withholding period. At the expiration of the predetermined withholding period, the pressure control device 16 is placed in an operated state to permit the fluid of the supply portion 12 to pressurize the demand portion 14 so that each of the activated sprinklers 24 is provided with a delivered water pressure at or greater than its minimum operating pressure.

Figure 3:
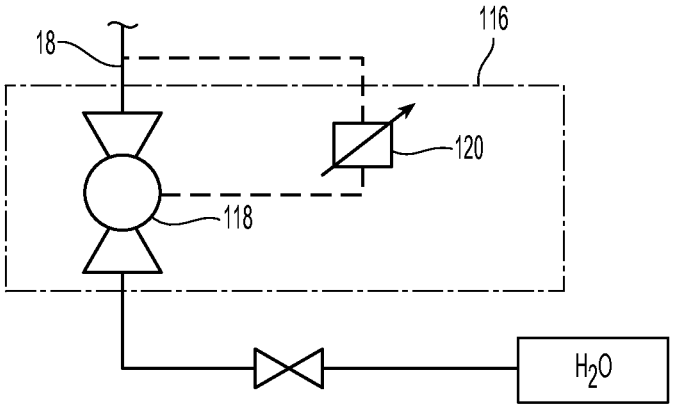
FIG. 3 is a schematic illustration of a preferred pressure control assembly for use in the system of FIG. 2.

A preferred embodiment of the pressure control device 116 is shown in FIG. 3, which preferably includes a fluid flow control valve 118, such as for example a differential pressure flow control valve, coupled to a timing device or timer 120. In the standby state of the device 116, the fluid control valve 118 is closed to prevent fluid from the supply portion 12 pressurizing the demand portion 14. Upon thermal actuation of at least one sprinkler 24, the timer 120 initiates a countdown of the predetermined withholding period. Detection of the sprinkler activation can be derived from or sensed from monitoring of the demand portion 14 of the system 10, including detection of a drop in the initial pressure in the demand portion 14 or detection of fluid flow through the pipes of the demand portion 14. Upon expiration of the predetermined withholding period, the valve 118 transitions from the standby state to the operated state, thereby placing the supply portion 12 in fluid communication with the demand portion 14 to pressurize the demand portion 14 and each of its sprinklers 24 to its minimum operating pressure or greater. The timer 120 can be any one of a mechanical or electrical timer and the timer 120 can be coupled to the fluid control valve 118 mechanically, electrically or by a combination thereof. Other device and/or valve arrangements are possible to control the flow and pressurization of the demand portion 14 by the supply portion 12 so long as the arrangement is capable of controlling its operation for the predetermined period of time following thermal actuation of at least one sprinkler 24 in the system 10.

As previously described, the withholding period is preferably predetermined so as to permit a desired number or sequence of sprinkler activations before full fluid (water) pressurization of the system piping. The preferred withholding period is preferably a function of the thermal responsiveness of the automatic sprinklers 24 of the system 10. More preferably, the withholding period of the system is preferably a function of the thermal sensitivity and temperature rating of the automatic sprinklers 24 to be used in the system 10. An "automatic sprinkler" is defined as a fire suppression or control device that operates automatically when its heat-activated element is heated to its thermal rating or above, allowing water to discharge over a specified area. The heat-activated element and thermally responsive trigger maintain a seal assembly in its place and prevent the discharge of water during the unactuated state of the sprinkler and system. The thermal trigger can be either a thermally responsive bulb as seen, for example, in U.S. Pat. No. 5,664,630 or a strut, lever and solder link assembly as seen, for example, in U.S. Pat. No. 7,730,959. In response to a fire, the heat-activated fluid within the glass bulb trigger expands and shatters the bulb or, in the case of a link and lever trigger, the solder melts and the strut and lever operate against one another. Regardless of the type of trigger, thermal activation in response to a fire removes the support of the trigger from the seal assembly and the seal assembly is displaced to permit the discharge of fluid from the sprinkler.

Figure 4:
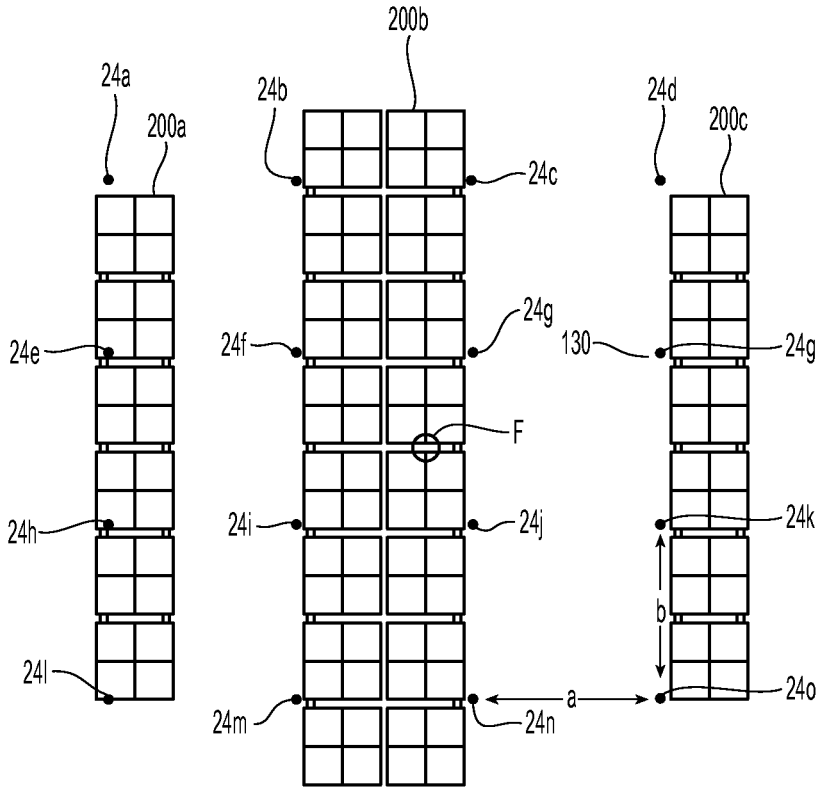
FIG. 4 is a plan schematic illustration of a free-burn test setup.

Nominal temperature rating and RTI are thermal characteristics of a sprinkler that are independent of the sprinkler's particular installation or application. However, there are installation factors that can impact a sprinkler's response to a fire. The factors include: (i) ceiling height; (ii) sprinkler spacing; (iii) ambient room temperature; and (iv) distance below the sprinkler. Given these various sprinkler response factors, a preferred method is provided for determining a preferred withholding time for use in a preferred wet system or methods of designing such systems to affect a preferred sequence of sprinkler activations as previously described. In the preferred method, a group of test sprinklers 24*a*-24*o*, having a known RTI and temperature rating, are installed in a test grid or array above a commodity arrangement, as shown for example in FIG. 4, and subjected to a test fire within the commodity with no water being introduced, i.e., a free burn test. An illustrative test can include sprinklers 24 for use in the system 10 that are standard response sprinklers with a nominal RTI of 80 $m^{1/2}$ $sec^{1/2}$ or higher and a nominal temperature rating of 300° F., and more preferably rated at 286° F. Alternatively, the sprinklers 24 can be specified to be fast, quick, or special response, having a temperature greater than or less than 286° F. and an alternate RTI, i.e., less than 80 $m^{1/2}$ $sec^{1/2}$ and greater than zero $m^{1/2}$ $sec^{1/2}$, so long as the temperature rating and thermal sensitivity provide for the desired thermal responsiveness in the sprinkler and the desired activation sequence. The sprinklers 24 can thus be specified within the range of temperature ratings and temperature classifications as listed in Table 6.2.5.1 of NFPA 13. For example, a sprinkler can be characterized with any one of: (i) an ordinary temperature classification with a temperature rating between 130-175° F.; (ii) an intermediate temperature classification with a temperature rating between 175-225° F.; (iii) a high temperature classification with a temperature rating between 250-300° F.; (iv) an extra high temperature classification with a temperature rating between 325-375° F.; (v) a very extra high temperature classification with a temperature rating between 400-475° F.; or (v) an ultra-high temperature classification with a temperature rating between 500-575° F. or 650° F.

The test fire is preferably located and substantially centered between four sprinklers. During the free burn test, the location and activation time of each sprinkler is determined. A preferred withholding time is determined as the time to actuation of the four sprinklers substantially centered about the test fire with no other sprinkler being actuated. A more preferred withholding time is determined as the time to actuation of the four sprinklers substantially centered about the test fire plus an additional three to five seconds (3-5 seconds) with no other sprinklers being actuated. The additional three to five seconds provide for a preferred cushion time, to ensure that there are no more than the four actuated sprinklers at the conclusion of the preferred predetermined withholding period.

To verify the appropriateness of the selection of sprinklers 24 for use in the system 10 and the predetermined withholding period, fire testing can be conducted to determine the effectiveness of the sprinklers 24 to address a fire with water discharged at the designed pressure following the withholding period. A selected sprinkler and a predetermined withholding time for testing are incorporated in a test setup including a test sprinkler grid above a test commodity. The test arrangement includes a pressure control device or assembly 16 for controlling water pressure delivered to the test sprinklers 24. With an initial fill of water in the test grid, a test fire is ignited in the test commodity preferably centered between four sprinklers in the grid of test sprinklers 24. Following thermal actuation of one or more sprinklers, the fluid pressure is withheld from the test grid and the activated test sprinkler(s) for the predetermined withholding period. Upon expiration of the withholding period, the test grid is pressurized and the test sprinklers receive water at their minimum operating pressure or greater and water is discharged from the actuated sprinkler into the test area to address the fire for a test duration period. Accordingly, the fire testing further preferably identifies and/or verifies an appropriate operating pressure for use in the preferred system 10 subject to a withholding period.

Upon conclusion of the duration period, the total number of activated sprinklers is determined and an evaluation of the fire travel and damage to the test commodity is assessed to determine if the test sprinklers, when subjected to the withholding period and subsequent operating pressure, satisfied the requirements for the desired performance, i.e., fire control or fire suppression. Preferably, the total number of activated sprinklers at the conclusion of the test duration is fewer than twelve; and more preferably, the total number of activated sprinklers is any one of nine, six, five or four sprinklers to define a number of design sprinklers for use in the design and installation of the transient system 10. The identified operating pressure following the withholding period is preferably minimized to reduce the hydraulic demand requirements of a preferred system 10. Increasing the operating pressure increases the flow from the sprinkler and may reduce the total number of sprinkler activations following the withholding period, but may increase the total hydraulic demand of the system.

Figure 5A:
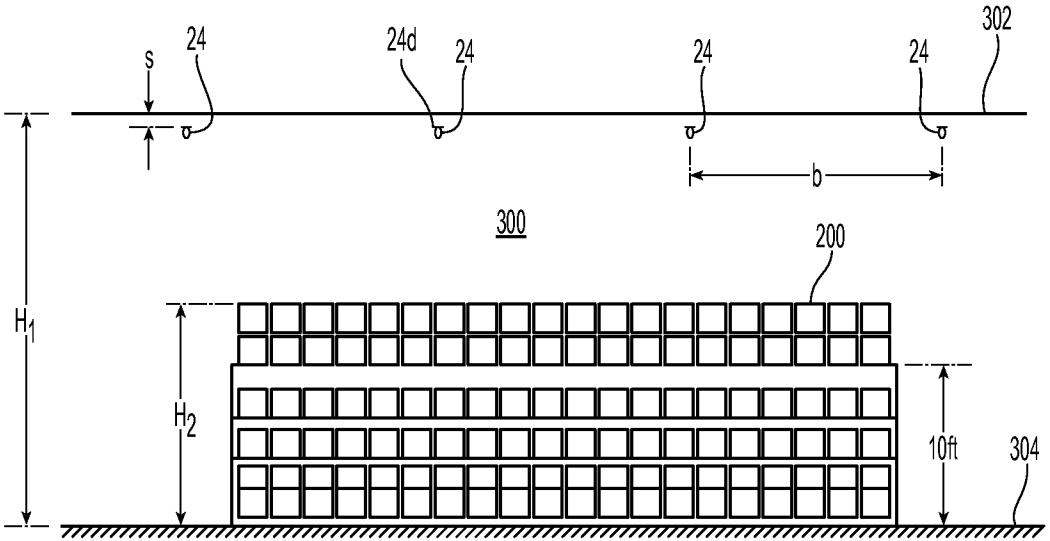
FIG. 5A is a schematic elevation view of one preferred installation of the system of FIG. 2.
Figure 5B:
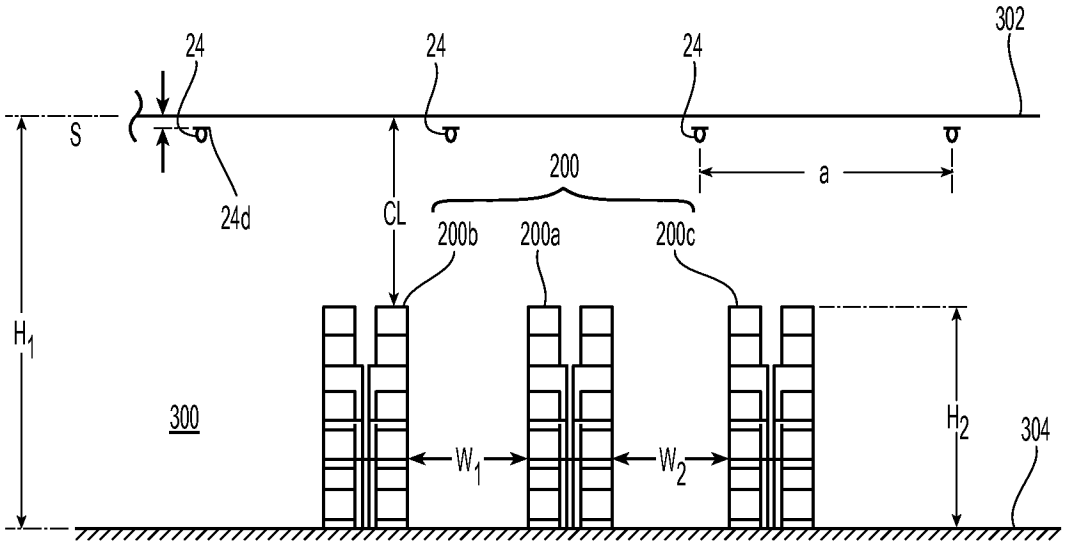
FIG. 5B is a schematic end view of the installation of FIG. 5A.

Shown schematically in FIGS. 5A-5B are respective elevation side and elevation end views of a preferred test system setup in the storage area 300 above the rack stored commodity 200. Parameters defining the system installation preferably include ceiling height H1 of the storage occupancy 300, classification of the commodity 200 and the storage arrangement and height of the commodity 200 to be protected. The ceiling 302 of the storage occupancy 300 can be of any configuration including any one of: a flat ceiling, horizontal ceiling, sloped ceiling or combinations thereof. The ceiling height H1 is preferably defined by the distance between the floor 304 and the underside of the ceiling 302 (or roof deck) within the storage area to be protected, and more preferably defines the maximum height between the floor and the underside of the ceiling (or roof deck). The stored commodity 200 is configured as a commodity array preferably of a type which can include any one of NFPA 13 defined Class I, II, III or IV commodities, alternatively Group A, Group B, or Group C plastics, elastomers, and rubbers, or further in the alternative any type of commodity capable of having its combustion behavior characterized. The array can be stored to a storage height H2, in which the storage height H2 preferably defines the maximum height of the storage and a nominal ceiling-to-storage clearance CL between the ceiling and the top of the highest stored commodity.

The storage height H2 can be alternatively defined to appropriately characterize the storage configuration. Preferably the storage height H2 ranges between twenty feet and fifty feet (20-50 ft.). Accordingly, for a minimum nominal ceiling-to-storage clearance CL of five feet (5 ft.), the nominal ceiling height can correspondingly range from twenty-five to fifty-five feet (25-55 ft.). The stored commodity array 200 preferably defines a rack arrangement, preferably a multi-row rack storage arrangement; and even more preferably a double-row rack storage arrangement but other storage configurations as defined by NFPA 13 are possible, such as for example, on floor, rack without solid shelves, palletized, bin box, shelf, or single-row rack. The storage area can also include additional storage of the same or different commodity spaced at an aisle width W in the same or different configuration. More preferably, the array 200 can include a main array 200*a* and one or more target arrays 200*b*, 200*c*, each defining an aisle width W1, W2 to the main array. The tested sprinklers 24 preferably include a deflector member 24*d* located from the ceiling at a nominal deflector-to-ceiling distance S. The sprinklers 24 and their deflector members 24*d* can define an upright arrangement or alternatively define a pendent arrangement. The sprinklers 24 are preferably mounted to and spaced along the spaced-apart branch pipes 22 to form a desired sprinkler spacing. The sprinkler-to-sprinkler spacing can be six feet-by-six feet (6 ft.×6 ft.); eight feet-by-eight feet (8 ft.×8 ft.), ten feet-by-ten feet (10 ft.×10 ft.), twenty feet-by-twenty feet (20 ft.×20 ft. spacing) and any combinations thereof or a range greater than or in between.

It is believed that withholding a fluid pressure for a predetermined withholding period following thermal actuation of one or more sprinklers reduces the total number of activated sprinklers to effectively address the fire as compared to wet sprinkler systems that do not employ a withholding period. With fewer anticipated sprinkler activations in the preferred transient wet system 10 employing a withholding period, there is less of a water demand as compared to a wet system that does not employ a withholding system.

NFPA 13 (2013) provides various design approaches for hydraulically designed wet systems. A hydraulically designed system provides for the selection of pipe sizes on a pressure loss basis to provide a prescribed water density, in gallons per minute per square foot (GPM/SQ. FT.), or a prescribed minimum discharge pressure or flow per sprinkler, i.e., minimum operating pressure, distributed with a reasonable degree of uniformity over a specified area for a given occupancy. An occupancy can be defined by the classification of the hazard of the occupancy, i.e., light hazard, ordinary hazard, extra hazard, or special occupancy hazard. A special occupancy hazard includes storage occupancies defined by the commodity class of the storage being stored and the makeup of the storage units. One hydraulic design approach for storage occupancies includes a design area method in which a design area is defined by a number of spaced hydraulically remote sprinklers under one or more industry accepted standards to provide for the prescribed water density, minimum discharge pressure or flow. "Hydraulically remote sprinklers" are those sprinklers that place the greatest water demand on a system in order to provide a prescribed minimum discharge pressure or flow. It is understood that a hydraulically remote sprinkler may not necessarily be those sprinklers that are physically located the furthest from the fluid supply or a control valve controlling the flow of fluid from the fluid supply.

Known wet fire protection systems for storage occupancies, without the withholding period, are hydraulically designed under NFPA 13 (2013) based upon providing a minimum pressure of water to a design area defined by a requisite number of the most hydraulically demanding sprinklers, i.e., the design sprinklers. For example, Section 16.3.2 of NFPA 13 provides that a wet fire protection system for rack storage of Class I-IV commodity over twenty-five feet employing control mode specific application (CMSA) sprinklers requires either fifteen design sprinklers (without in-rack sprinklers, i.e., a ceiling-only system) or twenty design sprinklers (with in-rack sprinklers, i.e., with sprinkler installed in the storage racks) with a minimum operating pressure being any one of 15 PSI, 25 PSI or 30 PSI, depending on the maximum storage height, maximum ceiling height, and K-factor. As used herein, the K-factor is defined as a constant representing the sprinkler discharge coefficient that is quantified by the flow of fluid in gallons per minute (GPM) from the sprinkler outlet divided by the square root of the pressure of the flow of fluid fed into the inlet of the sprinkler passageway in pounds per square inch (PSI), expressed as GPM/$(PSI)^{1/2}$. A rated or nominal K-factor or discharge coefficient of a sprinkler is a mean value over a K-factor range. As used herein, "nominal" describes a numerical value, designated under an accepted standard, about which a measured parameter may vary as defined by an accepted tolerance range, e.g., plus or minus 5%. Examples of Industry accepted nominal K-factors of 11 GPM/$(PSI)^{1/2}$ or greater include the following (with the K-factor range shown in parenthesis): (i) 11.2 (10.7-11.7) GPM/$(PSI)^{1/2}$; (ii) 14.0 (13.5-14.5) GPM/$(PSI)^{1/2}$; (iii) 16.8 (16.0-17.6) GPM/$(PSI)^{1/2}$; (iv) 19.6 (18.6-20.6) GPM/$(PSI)^{1/2}$; (v) 22.4 (21.3-23.5) GPM/$(PSI)^{1/2}$; (vi) 25.2 (23.9-26.5) GPM/$(PSI)^{1/2}$; and (vii) 28.0 (26.6-29.4) GPM/$(PSI)^{1/2}$.

For higher hazards, such as for example, Group A plastics rack storage over twenty-five feet, Section 17.3.2 of NFPA identifies only pendent CMSA sprinklers having a K-Factor of 19.6 GPM/$(PSI)^{1/2}$. Moreover, NFPA 13 requires for such high hazard commodity that the design area be defined by a rectangle in which the length is equal to 1.2 times the square root of the area protected by the number of sprinklers to be included in the design area. NFPA 13 requires a minimum of fifteen (15) design sprinklers for such a storage arrangement.

Figure 2:
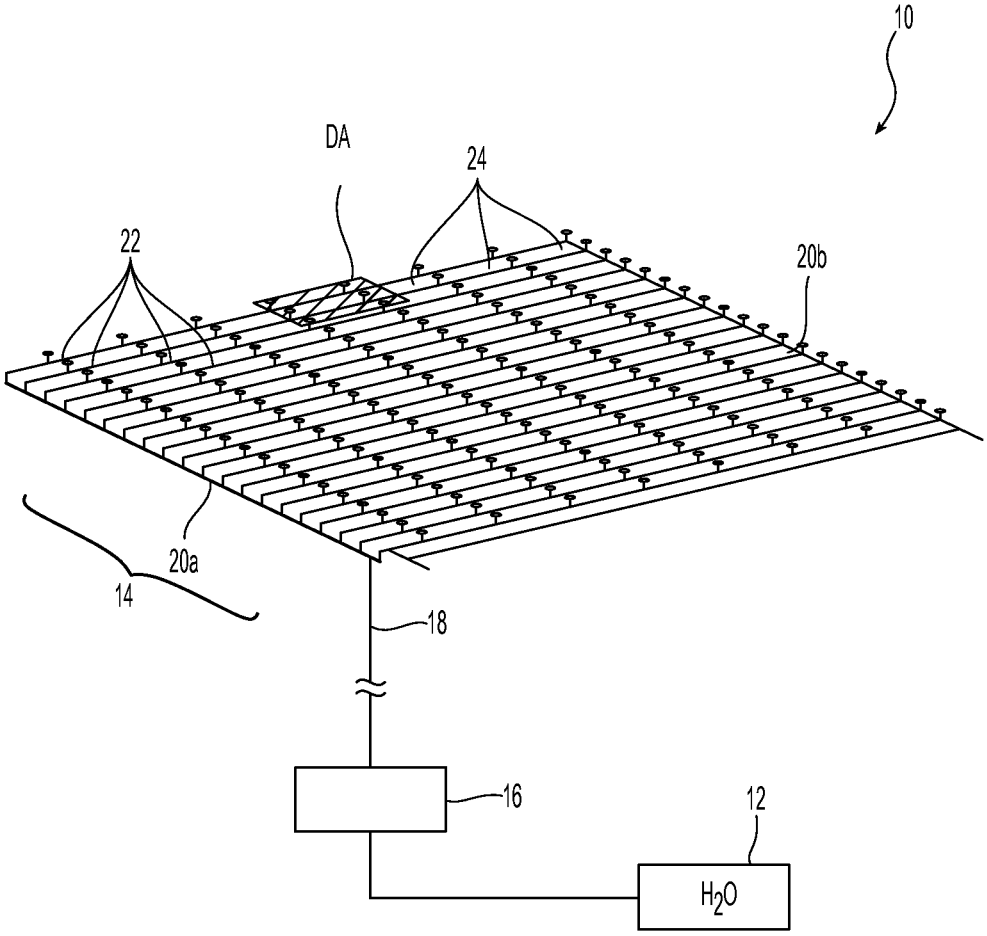
FIG. 2 is a schematic illustration of the wet fire protection system of FIG. 1.

In contrast and with reference to FIG. 2, a preferred embodiment of the system 10 provides CMSA protection ceiling-only (without in-rack sprinklers) with an appropriate withholding period that is hydraulically designed with fewer than fifteen sprinklers. In one preferred embodiment of the system 10, the number of design sprinklers is determined by the number of actuated sprinklers resulting from free burn testing and sprinkler performance fire testing, subject to a withholding period, as previously described. More preferably, the number of design sprinklers is determined by the number of actuated sprinklers subject to such testing and increased by a design factor, such as for example, a preferred design factor of 1.5. Alternatively or additionally, a preferred design area of the system can be defined by a rectangle in which the length is equal to 1.2 times the square root of the area protected by the preferred number of design sprinklers appropriately increased so as to include any fractional sprinkler in the design area.

The minimum operating pressure and the K-factor of the design sprinklers in the preferred design area of a fire protection system 10 define the minimum hydraulic requirements of the system. In one preferred embodiment of the system 10, the minimum operating pressure is determined to be equal to the fluid pressure shown to effectively address a test fire with the desired fire control or suppression when delivered to the actuated sprinklers in the sprinkler performance fire testing, subject to a withholding period, as previously described. The flow of water from a single sprinkler can be determined by the following sprinkler formula: K-Factor=$Q/P^{1/2}$. A preferred embodiment of the system 10 includes sprinklers having a nominal K-factor of 16.8 GPM/$(PSI)^{1/2}$ or greater. Alternatively, the sprinklers 24 can be of any nominal K-factor provided they are installed and configured in a system to deliver a flow of fluid in accordance with the preferred hydraulic and system requirements. More specifically, the sprinkler 24 can have a nominal K-factor of 11.2; 14.0; 16.8; 19.6; 22.4; 25.2; 28.0 (GPM)/(PSI)$^{1/2}$ or greater. In one aspect, the nominal K-factor is preferably over 28.0 GPM/(PSI)$^{1/2}$ by a whole multiple of 5.6 (plus or minus 5%), such as for example a nominal K-factor of 33.6 GPM/(PSI)$^{1/2}$ (31.9-35.28). With the flow from each sprinkler determined, the total flow requirement of the system can be determined by multiplying the total number of design sprinklers defining the preferred design area DA by the flow (Q) per sprinkler.

The effectiveness of a system employing a predetermined withholding period has been verified using nominal 16.8 GPM/(PSI)$^{1/2}$ control mode specific application (CMSA) upright sprinklers in a fire test employing a twelve second withholding period. The sprinkler performance and fire testing showed that a preferred system subject to a predetermined withholding period and sufficient operating pressure defines a lower hydraulic demand as compared to prior known wet system designs that do not use a withholding period. Summarized in the table below are the comparative test parameters and results from fire testing of two CMSA sprinkler installations above common storage conditions, one with a predetermined withholding period and the other without. The comparison chart below shows how the reduced design area DA of the preferred system 10 using a predetermined withholding period requires less water as compared to known wet system designs that do not use a predetermined withholding period.

design sprinklers define an area of protection of 2100 square feet (sq. ft.) and a rectangular design area with a length of fifty-five feet (55 ft.). The reduced length in the rectangular design area of the preferred system employing a withholding period can reduce the number of sprinklers on a branch line of the piping system. By reducing the number of required sprinklers on a branch line, the hydraulic demand of each branch line is reduced, which can provide for reduced branch line sizes as compared to known wet systems that do not employ a withholding period.

The transient preferred wet fire protection system 10 can be installed in any acceptable manner so long as the installation provides for the withholding period, requisite minimum operating pressure, and preferred hydraulic design areas as previously defined. In one embodiment, the system 10 could be installed in accordance with the installation criteria provided under NFPA 13 or FM Global Standard. Additionally, the installation of the sprinklers 24 is preferably defined by one or more installation parameters including, for example, the storage occupancy parameters, the storage arrangement parameters and the sprinkler location parameters used in the previously described test arrangements.

Systems and methods previously described can provide for preferred control mode specific application (CMSA) design parameters in a transient system 10 to provide ceiling-only rack storage protection for a storage occupancy 300 having a nominal ceiling height H of up to thirty-five feet (35 ft.) to protect a rack storage arrangement of Group A plastics and/or Class I-IV commodities ranging from a

| | Max Storage Height | Max Ceiling Height | K-FACTOR GPM/(PSI)$^{1/2}$ | Min. Operating Pressure (PSI.) | No. of Sprinkler Activations | No. of Design Sprinklers (1.5 Design Factor) |
|---|---|---|---|---|---|---|
| With a 12 Sec. Withholding Period | 30 ft. | 35 ft. | 16.8 | 35 psi. | 8 | 12 |
| Without Withholding Period | 30 ft. | 35 ft. | 16.8 | 35 psi. | 14 | 21 |

Particularly shown in the above table are the number of sprinkler activations under the fire test. A ceiling-only system including a twelve second (12 sec.) withholding period provides for fewer sprinkler activations as compared to a system without a withholding period. Provided at the end of the table is one preferred embodiment of the number of design sprinklers in which the number of design sprinklers is equal to the number of sprinkler activations under the test multiplied by a design factor of 1.5. The difference in the number of design sprinklers between a preferred system having a withholding period and a wet system without a withholding period can provide for a 42% decrease in the number of design sprinklers for a system with a holding period as compared to a system without.

As previously noted, a preferred design area of the system can be defined by a rectangle in which the length is equal to 1.2 times the square root of the area of protection for the preferred number of design sprinklers appropriately increased so as to include any fractional sprinkler in the design area. Assuming the preferred design sprinklers have a coverage area of 100 square feet, the preferred system 10 and the twelve design sprinklers define a preferred area of protection of 1200 square feet (sq. ft.) and a rectangular design area with a length of forty-two feet (42 ft.). In the wet system without the withholding period, the twenty-one minimum storage height of 20 feet to a maximum storage height of 30 feet. One preferred embodiment of design parameters for transient system design protection of a nominal storage height H2 ranging from 20 ft.-30 ft. of rack storage of Group A plastic and/or Class I-IV commodity under a nominal ceiling height of 35 ft. to define a nominal clearance of 5-15 feet using a preferably upright, nominal 16.8 K-Factor CMSA standard response (RTI of 80 m$^{112}$ sec$^{1/2}$ or greater) sprinklers with a 285° F. temperature rating and includes: (i) a deflector-to-ceiling distance of 12 inches; (ii) a sprinkler-to-sprinkler spacing of 10 ft.×10 ft.; (iii) a predetermined withholding period of 10-15 seconds and more preferably 12 seconds; and (iv) a hydraulic design of eight (8) sprinkler design sprinklers with a minimum operating pressure of 35 PSI. In light of the preferred parameters, the total minimum flow requirement of this embodiment of the system is determined to be about 795 GPM with the preferred eight (8) design sprinklers multiplied by the minimum flow (Q) of 99.3 GPM from each sprinkler operating at the minimum operating pressure of 35 PSI.

Another preferred embodiment of design parameters for transient, preferably ceiling-only, system design protection of a nominal storage height H2 ranging from 20 ft.-30 ft. of rack storage of Group A plastic and/or Class I-IV commodity under a nominal ceiling height of 35 ft. to define a nominal clearance of 5-15 feet using upright, nominal 16.8 K-Factor CMSA standard response sprinklers with a 285° F. temperature rating includes: (i) a deflector-to-ceiling distance of 12 inches; (ii) a sprinkler-to-sprinkler spacing of 10 ft.×10 ft.; (iii) a predetermined withholding period of 10-15 seconds and more preferably 12 seconds; and (iv) a hydraulic design of twelve (12) sprinkler design sprinklers with a minimum operating pressure of 35 PSI. In light of the preferred parameters, the total minimum flow requirement of this embodiment of the system is determined to be about 1193 GPM with the preferred twelve (12) design sprinklers multiplied by the minimum flow (Q) of 99.3 GPM from each sprinkler operating at the minimum operating pressure of 35 PSI.

Another embodiment of a preferred system design parameters for transient, preferably ceiling-only, system design protection of a nominal storage height H2 ranging from 35 ft.-40 ft. of rack storage of Group A plastic and/or Class I-IV commodity under a nominal ceiling height of 45 ft. to define a nominal clearance of 10-15 feet using upright, nominal 25.2 K-Factor fast response sprinklers with a 212° F. temperature rating includes: (i) a deflector-to-ceiling distance of six inches (6 in.); (ii) a sprinkler-to-sprinkler spacing of 10 ft.×10 ft.; (iii) a predetermined withholding period of 7-9 seconds; and (iv) a hydraulic design of either one of eight (8) or twelve (12) sprinkler design sprinklers with a minimum operating pressure of 45 PSI. Accordingly, preferred embodiments of system design parameters provide transient systems using standard response or fast response sprinklers. Thus in the alternative, embodiments of the preferred system parameters described herein can include the use of sprinklers having a thermally responsive trigger with an RTI greater than 80 $m^{1/2}$ $sec^{1/2}$ and more preferably greater than 100 $m^{1/2}$ $sec^{1/2}$; or less than 80 $m^{1/2}$ $sec^{1/2}$ and more preferably less than 50 $m^{1/2}$ $sec^{1/2}$ and greater than zero or greater.

In addition to providing for systems with varying thermal sensitivity, the preferred methods and design parameters can provide fire protection at storage and ceiling heights not available under previously known systems or design standards. Based on fire testing, design parameters have been determined to provide for fire protection at the higher heights of storage. A preferred embodiment of design parameters for transient, preferably ceiling-only, system design protection of a nominal storage height H2 ranging from 40 ft.-50 ft. of rack storage of Class I-IV commodity under a nominal ceiling height of 50 ft.-55 ft. to define a nominal clearance of 5-15 feet using upright, nominal 33.6 K-Factor standard response sprinklers with a 286° F. temperature rating includes: (i) a deflector-to-ceiling distance of twelve inches (12 in.); (ii) a sprinkler-to-sprinkler spacing of 10 ft.×10 ft.; (iii) a predetermined withholding period of 5-10 seconds; and (iv) a hydraulic design of either one of six (6), seven (7), eight (8) or nine (9) sprinkler design sprinklers with a minimum operating pressure of 50 PSI. The thermal sensitivity of the preferred standard response sprinkler can be up to 140 $m^{112}$ $sec^{1/2}$. In light of the preferred parameters, the total minimum flow requirement of this embodiment of the system is determined to be about 1428 GPM; 1666 GPM; 1904 GPM and 2142 GPM respectively for the preferred six (6), seven (7), eight (8) or nine (9) sprinkler design sprinklers multiplied by the minimum flow (Q) of 238 GPM from each sprinkler operating at the minimum operating pressure of 50 PSI. Accordingly, a preferred transient system using a nominal 33.6 K-Factor upright sprinkler with a standard response trigger, for example greater than 100 $m^{1/2}$ $sec^{1/2}$ and more preferably 140 $m^{112}$ $sec^{1/2}$, can define a total minimum flow requirement that ranges from 1428 GPM-2142 GPM.

Comparatively, the total flow requirements under the preferred design parameters are approximately equal to and more preferably lower that the total flow requirements of a wet ceiling-only system protecting a similar commodity at storage heights of fifty feet (50 ft.) or less. For example, known Early Suppression Fast Response (ESFR) sprinkler protection of rack storage of Class I-IV up to a maximum forty-three feet (43 ft.) in height beneath a maximum ceiling height of forty-eight feet (48 ft.) using nominal K-25.2 ESFR pendent sprinklers at a minimum operating pressure of 45 PSI. with twelve (12) deign sprinklers, has a total minimum flow requirement of 2028 GPM (not including a 250 GPM hose stream allowance). Thus, the preferred systems and methods incorporating a preferred predetermined withholding period provide for ceiling-only fire protection at storage heights not yet hereto available and depending upon the system design selected, with less total flow requirements.

As with any commercial installation of a fire protection system, it would be desirable for a commercial embodiment of the preferred system 10 to be approved by the local authority having jurisdiction. One preferred method of approving the preferred wet fire protection system 10 includes determining that the system includes a pressure control device configured to operate at the expiration of a predetermined withholding period for the delivery of water to each of a plurality of sprinklers in the system at a pressure equal to or greater than the minimum operating pressure of the sprinklers; and verifying the most hydraulically demanding sprinkler is pressurized at the minimum operating pressure or greater following discharge of water from the demand portion and the expiration of the withholding period.

In addition to reducing the water demand, the resulting design area and total flow requirement for preferred transient wet systems employing a withholding period can define reduced pipe sizes as compared to wet systems that do not use a withholding period. For example, the total flow through the hydraulic design area can be a driving determiner of the pipe size for the main piping 20. Main piping 20 is typically significantly larger than branch line piping 22 for high piled storage. The larger the total flow of the system, the larger the piping, the more significant the cost difference between adjacent pipe sizes and installation costs. For the preferred transient system 10 employing the preferred predetermined withholding period, the resulting total flow requirement through its design area is lower than known wet system designs and installations without the withholding period; and thus, the pipe sizes and installation costs of the preferred system 10 can be lower than in known systems. Additionally, because the preferred wet fire protection systems and methods of employing a predetermined withholding period can reduce the amount of total flow through the system, it may be possible to eliminate the need for a fire pump, which may have been required under previously known wet system designs, thereby adding additional cost savings to the preferred system 10.

The above preferred systems and methods can include obtaining and providing a fire protection sprinkler qualified for use in a system or method employing a withholding period as previously described. In one preferred aspect a sprinkler is preferably obtained for use in a fire protection system for the protection of a storage occupancy over a range of available ceiling heights H1 for the protection of a stored commodity 200 having a range of classifications and range of storage heights H2. Obtaining the preferred sprinkler can more specifically include designing, manufacturing and/or acquiring the sprinkler 24 for use in a fire protection system employing a withholding period. Another preferred aspect of the process of obtaining the sprinkler 24 can include identifying and/or qualifying the sprinkler for use in a fire protection system employing a withholding period. More preferably, the preferred sprinkler 24 can be fire tested in a manner substantially similar to the exemplary fire test previously described.

More preferably, the sprinkler 24 can be qualified in such a manner so as to be "listed," which is defined by NFPA 13, Section 3.2.3 (2013) as equipment, material or services included in a list published by an organization that is acceptable to the authority having jurisdiction and concerned with the evaluation of products or services and whose listing states that either the equipment, material or service meets appropriate designated standards or has been tested and found suitable for a specific purpose. For example, the preferred sprinkler 24 is listed by an organization approved by an authority having jurisdiction such as, for example, NFPA or UL for use in a fire protection system employing a withholding period for fire protection of, for example, any one of a Class I, II, III or IV commodity ranging in storage height from about twenty feet to about thirty feet (20-30 ft.) or, alternatively, a Group A plastic commodity having a storage height of about twenty feet to about thirty feet (20-30 ft.).

As an alternative to designing, manufacturing and/or qualifying a preferred system employing a withholding period, the process of obtaining the preferred system or any of its qualified components can entail, for example, acquiring such a system, subsystem or component. Acquiring the qualified sprinkler can further include receiving a qualified sprinkler, a preferred system or the designs and methods of such a system as described above from, for example, a supplier or manufacturer in the course of a business-to-business transaction, through a supply chain relationship such as between, for example, a manufacturer and supplier; between a manufacturer and retail supplier; or between a supplier and contractor/installer. Alternatively, acquisition of the system and/or its components can be accomplished through a contractual arrangement, for example, between a contractor/installer and storage occupancy owner/operator, a property transaction such as, for example, sale agreement between seller and buyer, or a lease agreement between lessor and lessee.

In addition, the preferred process of providing a method of fire protection can include distribution of the preferred fire protection system employing a withholding period, its subsystems, components and/or its methods of design, configuration and use in connection with the transaction of acquisition as described above. The distribution of the system, subsystem, and/or components, and/or its associated methods can include the process of packaging, inventorying or warehousing and/or shipping the system, subsystem, components and/or its associated methods of design, configuration and/or use. The shipping can include individual or bulk transport of the sprinkler over air, land or water. The avenues of distribution of preferred products and services can include transfer from one party to another party, such as for example, from a designer to a manufacturer or from a manufacture to a contractor/installer.

In one preferred aspect of the process of distribution, the process can further include publication of the preferred sprinkler system employing a withholding period, the subsystems, components and/or associated sprinklers, methods and applications of fire protection. For example, a preferred sprinkler can be published in a catalog for a sales offering by any one of a manufacturer and/or equipment supplier. The catalog can be a hard copy media, such as a paper catalog or brochure or, alternatively, the catalog can be in electronic format. For example, the catalog can be an on-line catalog available to a prospective buyer or user over a network such as, for example, a LAN, WAN or the Internet.

The preferred process of distribution can further include distributing a method for designing a fire protection system employing a withholding period. Distributing the method can include publication of a database of design criteria as an electronic data sheet, such as for example, at least one of an .html, .pdf, or editable text file. Where the process of distribution provides for publication of the preferred fire protection systems employing a withholding period, its subsystems and its associated methods in a hard copy media format, the distribution process can further include distribution of the cataloged information with the product or service being distributed. For example, a paper copy of the data sheet for a preferred sprinkler can be included in the packaging for the sprinkler to provide installation or configuration information to a user. The hard copy data sheet preferably includes the necessary design criteria to assist a designer, installer, or end user in configuring a fire protection system employing a withholding period.

More preferably, the preferred methods of distribution, system design and/or transient systems as described above include identification of one or more sprinkler design factors DF, which defines or relates the preferred withholding period with one or more parameters of the sprinkler or the storage arrangement. For example, a first sprinkler design factor DF1 can include a specified withholding period and a maximum nominal storage height H2. The design factor can includes a maximum nominal ceiling height H1 and/or a maximum storage-to-ceiling clearance CL. Alternatively or additionally, a second sprinkler design factor DF2 can include for example, the specified withholding period and a corresponding deflector-to-ceiling distance S. Alternatively, or additionally, another or design factor DF3 for identification can include a withholding period in combination with at least one of thermal sensitivity RTI and temperature rating.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A wet ceiling-only fire protection system for protection of a stored commodity, the system comprising:

a demand portion including a network of pipes and a plurality of sprinklers disposed above the commodity, each sprinkler having a minimum designed operating pressure and a thermal responsiveness, wherein the plurality of sprinklers are interconnected by the network of pipes filled with water to provide each sprinkler of the plurality of sprinklers with an initial pressure in an unactuated state of the system; and a control device comprising:

a pressure sensor disposed in a main line between and coupled with a fluid supply portion and the demand portion, the control device configured to withhold fluid pressure from the demand portion following actuation of at least one of the plurality of sprinklers for a predetermined withholding period, wherein the predetermined withholding period is a function of the thermal responsiveness of the plurality of sprinklers;

a valve having a standby state which prevents fluid communication between the fluid supply portion and the demand portion and an operated state which permits fluid communication between the fluid supply portion and the demand portion; and a timer configured to initiate countdown of the predetermined withholding period, the timer coupled to the valve to transition the valve from the standby state to the operated state upon expiration of the predetermined withholding period.

2. The wet ceiling-only fire protection system of claim 1, wherein the predetermined withholding period is greater than zero and less than fifteen seconds.

3. The wet ceiling-only fire protection system of claim 2, wherein the predetermined withholding period is greater than zero and less than ten seconds.

4. The wet ceiling-only fire protection system of claim 3, wherein the predetermined withholding period ranges between five seconds and less than ten seconds.

5. The wet ceiling-only fire protection system of claim 1, the plurality of sprinklers including standard response sprinklers with a K-Factor greater than 11 and wherein the withholding period ranges from 5-15 seconds.

6. The wet ceiling-only fire protection system of claim 5, wherein the sprinklers are disposed to define a deflector-to-ceiling distance of twelve inches (12 in.).

7. The wet ceiling-only fire protection system of claim 6, wherein the plurality of sprinklers are disposed above rack storage having a nominal storage height ranging from 20 ft.-30 ft. under a nominal ceiling height of 35 ft. to define a nominal clearance of 5-15 feet, the plurality of sprinklers having a nominal 16.8 K-factor and disposed at a sprinkler-to-sprinkler spacing of 10 ft.×10 ft., the demand portion including one of eight (8) or twelve (12) design sprinklers with a minimum operating pressure of 35 PSI.

8. The wet ceiling-only fire protection system of claim 6, wherein the plurality of sprinklers are disposed above rack storage having a nominal storage height ranging from 40 ft.-50 ft. under a nominal ceiling height ranging from 50 ft.-55 ft. to define a nominal clearance of 5-15 feet, the plurality of sprinklers having a nominal 33.6 K-factor and disposed at a sprinkler-to-sprinkler spacing of 10 ft.×10 ft., the demand portion including one of one of six (6), seven (7), eight (8) or nine (9) design sprinklers with a minimum operating pressure of 50 PSI, the withholding period ranging from 5-10 seconds.

9. The wet ceiling-only fire protection system claim 7, wherein the sprinklers have a temperature rating of 286° F.

10. The wet ceiling-only fire protection system of claim 1, wherein the plurality of sprinklers include fast response sprinklers with K-Factor greater than 11 and the withholding period ranges from 5-15 seconds.

11. The wet ceiling-only fire protection system of claim 10, wherein the sprinklers are disposed at a deflector-to-ceiling distance of six inches (6 in.).

12. The wet ceiling-only fire protection system of claim 10, wherein the plurality of sprinklers is disposed above rack storage of Group A plastic and/or Class I-IV commodity having a nominal storage height ranging from 30 ft.-40 ft. under a nominal ceiling height of 45 ft. to define a nominal clearance of 10-15 feet, the sprinklers having a nominal 25.2 K-factor disposed at a sprinkler-to-sprinkler spacing of 10 ft.×10 ft., the demand portion including one of eight (8) or twelve (12) design sprinklers with a minimum operating pressure of 45 PSI, the withholding period ranging from 7-9 seconds.

13. The wet ceiling-only fire protection system of claim 10, wherein the sprinklers have a temperature rating of 212° F.

14. The wet ceiling-only fire protection system of claim 1, wherein the initial pressure is equal to or greater than the minimum designed operating pressure in the unactuated state of the system.

15. A method of providing a wet ceiling-only fire protection system having a supply portion and a demand portion including a plurality of sprinklers, each sprinkler having a minimum design operating pressure, the method comprising:

determining a withholding period for withholding fluid pressure from the demand portion of the system following actuation of at least one sprinkler in the demand portion in response to a fire;

specifying a design area of the demand portion, the design area being defined by a maximum number of sprinklers activated to one of control or suppress a fire in a fire test that incorporates the withholding period; and withholding, via a control device comprising a pressure sensor disposed in a main line between and coupled with the supply portion and the demand portion, fluid pressure from the demand portion following actuation of at least one of the plurality of sprinklers for a predetermined withholding period, the control device comprising:

a valve having a standby state which prevents fluid communication between the supply portion and the demand portion and an operated state which permits fluid communication between the supply portion and the demand portion; and a timer configured to initiate countdown of the predetermined withholding period, the timer coupled to the valve to transition the valve from the standby state to the operated state upon expiration of the predetermined withholding period.

16. The method of claim 15, wherein the design area is equal to a coverage area of the sprinkler multiplied by the maximum number of activated sprinklers.

17. The method of claim 15, wherein the design area is equal to a coverage area of the sprinkler multiplied by the maximum number of activated sprinklers multiplied by a design factor.

18. The method of claim 17, wherein the design factor is 1.5.

19. The method of claim 15, wherein the design area has a length defined by 1.2 multiplied by a square root of the design area.

20. The method of claim 15, further including specifying design criteria for protection of a nominal storage height ranging from 20 ft.-30 ft. of rack storage of Group A plastic and/or Class I-IV commodity under a nominal ceiling height of 35 ft. to define a nominal clearance of 5-15 feet using a nominal 16.8 K-Factor standard response sprinkler, the design criteria including: (i) a deflector-to-ceiling distance of 12 inches; (ii) a sprinkler-to-sprinkler spacing of 10 ft.×10 ft.; (iii) a predetermined withholding period ranging from 10-15 seconds; and (iv) one of eight (8) or twelve (12) design sprinklers with a minimum operating pressure of 35 PSI.

21. The method of claim 20, wherein the sprinkler has a temperature rating of 286° F.

22. The method of claim 15, further including specifying design criteria for protection of a nominal storage height ranging from 35 ft.-40 ft. of rack storage of Group A plastic and/or Class I-IV commodity under a nominal ceiling height of 45 ft. to define a nominal clearance of 10-15 feet using a nominal 25.2 K-Factor fast response sprinkler, the design criteria including: (i) a deflector-to-ceiling distance of six inches; (ii) a sprinkler-to-sprinkler spacing of 10 ft.×10 ft.; (iii) a predetermined withholding period ranging from 7-9 seconds; and (iv) one of eight (8) or twelve (12) design sprinklers with a minimum operating pressure of 45 PSI.

23. The method of claim 22, wherein the sprinkler has a temperature rating of 212° F.

24. The method of claim 15, further including specifying design criteria for protection of a nominal storage height ranging from 40 ft.-45 ft. of rack storage of Class I-IV commodity under a nominal ceiling height ranging from 50 ft.-55 ft. to define a nominal clearance of 5-15 feet using a nominal 33.6 K-Factor standard response sprinkler, the design criteria: (i) a deflector-to-ceiling distance of twelve inches (12 in.); (ii) a sprinkler-to-sprinkler spacing of 10 ft.×10 ft.; (iii) a predetermined withholding period ranging from 5-10 seconds; and (iv) one of six (6), seven (7), eight (8) or nine (9) design sprinklers with a minimum operating pressure of 50 PSI.

25. The method of claim 24, wherein the sprinkler has a temperature rating of 286° F.

26. A wet ceiling-only fire protection system for the protection of a stored commodity, the system comprising a pressure control device, the pressure control device comprising:

a pressure sensor disposed in a main line between and coupled with a fluid supply portion and a demand portion and configured to withhold fluid pressure from pressurizing a plurality of automatic fire protection sprinklers for a predetermined withholding period following thermal actuation of at least one of the plurality of automatic fire protection sprinklers, wherein the predetermined withholding period is a function of the thermal responsiveness of the plurality of automatic fire protection sprinklers;

a valve having a standby state which prevents fluid communication between the fluid supply portion and the demand portion and an operated state which permits fluid communication between the fluid supply portion and the demand portion; and a timer configured to initiate countdown of the predetermined withholding period, the timer coupled to the valve to transition the valve from the standby state to the operated state upon expiration of the predetermined withholding period.

* * * * *